United States Patent [19]

Shigematsu et al.

[11] Patent Number: 4,501,272

[45] Date of Patent: Feb. 26, 1985

[54] MASK

[75] Inventors: Kaisaburo Shigematsu; Nobuo Shigematsu, both of Urawa; Yukio Okubo, Kasukabe, all of Japan

[73] Assignee: Shigematsu Works Co., Ltd., Tokyo, Japan

[21] Appl. No.: 437,474

[22] Filed: Oct. 28, 1982

[30] Foreign Application Priority Data

| | | | |
|---|---|---|---|
| Oct. 30, 1981 | [JP] | Japan | 56-172871 |
| Oct. 30, 1981 | [JP] | Japan | 56-172870 |
| Nov. 21, 1981 | [JP] | Japan | 56-172653[U] |

[51] Int. Cl.[3] ..... A62B 7/00

[52] U.S. Cl. ..... 128/206.15; 128/206.17

[58] Field of Search ..... 128/139, 206.12–206.19

[56] References Cited

U.S. PATENT DOCUMENTS

| | | | |
|---|---|---|---|
| 2,114,358 | 4/1938 | Schwartz | 128/206.15 |
| 2,206,061 | 7/1940 | Splaine | 128/206.15 |
| 2,320,770 | 6/1943 | Cover | 128/206.15 |
| 2,798,483 | 7/1957 | Kashima | 128/206.15 |
| 2,811,967 | 11/1957 | Stampe | 128/206.15 |
| 3,249,106 | 5/1966 | Motsinger | 128/206.17 |

*Primary Examiner*—Henry J. Recla

*Attorney, Agent, or Firm*—Toren, McGeady and Stanger

[57] ABSTRACT

A mask in which an enclosure of an intake filtration chamber is partly or totally formed of a filtration medium so that a separate filtration medium need not be provided within the intake filtration chamber for replacement. The replacement of the filtration medium is effected by replacement of the entire intake filtration chamber. The invention provides a mask which is small in size and low in intake resistance and is free from a possible flow of contaminated air into the mask.

5 Claims, 10 Drawing Figures

MASK

BRIEF SUMMARY OF THE INVENTION

The present invention relates to an improvement in a respiration protective mask, particularly a dust-proof mask.

A conventional well known mask suffers from the disadvantage that contaminated air is suctioned into the mask due to a poor mounting of a filter medium when the latter is replaced.

A further disadvantage is that in case the intake chamber body 4 and the intake chamber cover are connected in a threaded manner, the shape of the intake chamber is limited to a circle and thus, a filtration area of the filter medium may be enlarged sufficiently to sufficiently reduce an intake resistance thereof. Since the intake resistance of the mask gives a load to aspiration of a mask wearer, it is preferably reduced as low as possible.

Moreover, in case the intake chamber body 4 and the intake chamber cover 5 are connected in a snap-fit manner, the shape of the intake chamber may be other than a circle, in which case, however, it is difficult to positively hold the outer edge portion of the filtration medium airtightly.

It is an object of the present invention to provide a mask which is free from a possible flow of contaminated air into the mask through an intake chamber of the mask, which is small in size and which is low in intake resistance, and an assembly of an intake chamber of a mask.

It is a further object of the present invention to provide a mask and an assembly of an intake chamber of a mask in which the mask is worn, the test of the contacting property of a portion of the mask in contact with a face can be made.

The characteristic of the present invention resides in that the peripheral wall of the intake chamber is partly or wholly formed of a filtration medium, and an intake chamber wholly formed into an indivisible suitable shape and an intake cylinder fastened to a suitable portion thereof constitute an assembly of an intake chamber so that replacement or exchange of the filtration medium is effected by the exchange of the entire assembly of the intake chamber.

In accordance with an present invention, an area of the filtration medium is increased without making the size of the mask so large, to considerably decrease the intake resistance.

Other and further objects, features and advantages of the invention will appear more fully from the following description.

DETAILED DESCRIPTION

Figure 1:
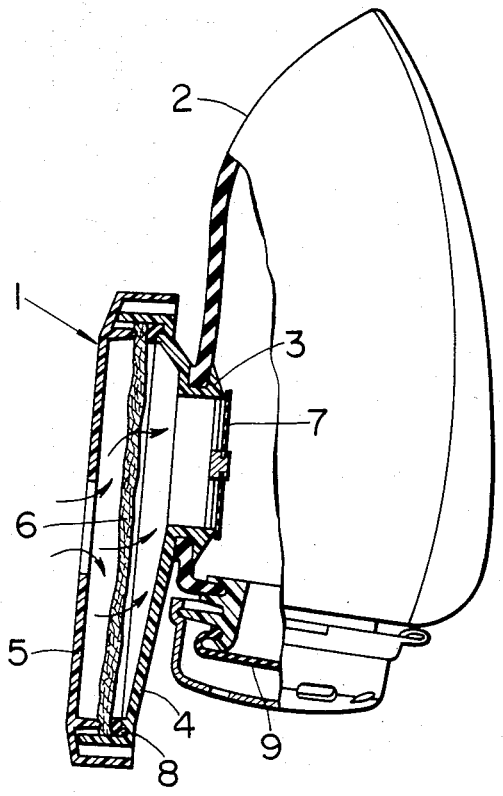
FIG. 1 is a cutaway side view of an essential portion of a conventional well known dust-proof mask.

In the conventional well known dust-proof mask shown in FIG. 1, an intake chamber assembly 1 thereof comprises an intake cylinder 3 fitted airtight in a mask body 2 made of rubber, an intake chamber body 4 molded integral with said intake cylinder 3, and an intake chamber cover 5 detachably mounted on the intake chamber body 4 by means of an engaging piece. In FIG. 1, reference numeral 6 denotes a filtration medium of which outer edge portion is held by the intake chamber body 4 and the intake chamber cover 5, 7 an intake valve, 8 a packing and 9 an expiration valve.

In the conventional well known intake chamber assembly 1, when the filtration medium is exchanged by a relatively insensitive user at site, it sometimes occurs that the whole outer edge portion of the filtration medium 6 is not positively held by the intake chamber body 4 and the intake chamber cover 5, in which case, there is a danger that the contaminated air is suctioned into the mask as it is.

Figure 2:
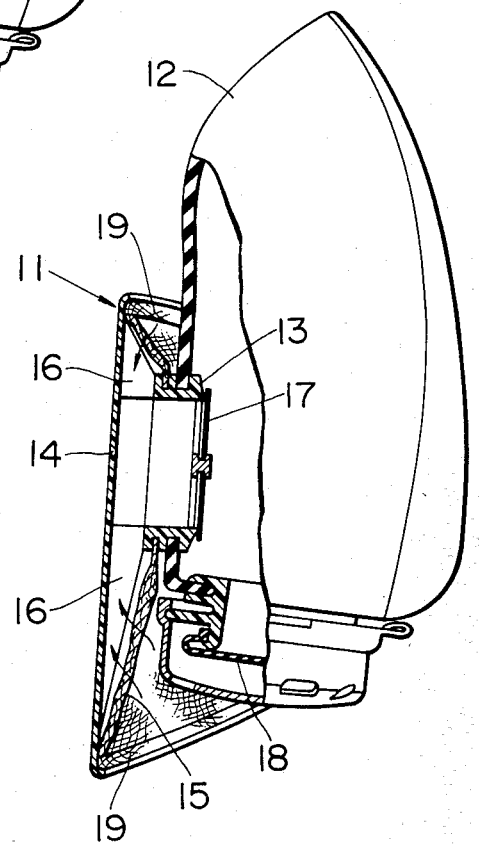
FIG. 2 is a cutaway side view of an essential portion showing an embodiment of the present invention.
Figure 3:
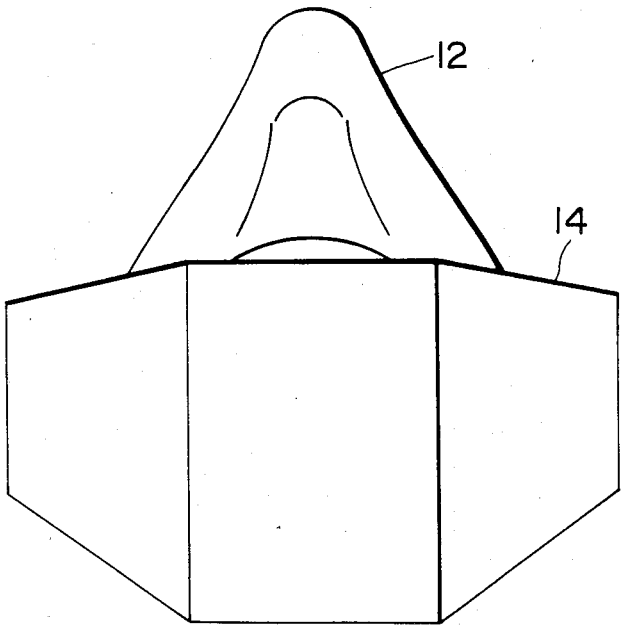
FIG. 3 is a front view in a reduced scale of a mask shown in FIG. 2.

FIG. 2 is a cutaway side view of an essential portion of a mask showing one embodiment of the present invention. An intake chamber assembly 11 comprises an intake cylinder 13 fitted airtight into a mounting mouth of a mask body 12 formed of rubber having a soft resiliency, a front wall 14 positioned opposedly to the intake cylinder 13, and a rear wall 15 composed of a filtration medium in which a fitting lip to be fitted in the intake cylinder 13 is fastened airtight to the intake cylinder 13 by deposition, adhesion and holding and the entire outer peripheral edge 19 thereof is fastened airtight to the front wall 14 by deposition, adhesion or the like. The intake chamber of the intake chamber assembly 11 is bent at its both sides towards the mask body 12. Between the intake cylinder 13 and the front wall 14 are provided connecting pieces 16 to connect them in a radially suitably spaced relation. Normally, the connecting pieces 16, the intake cylinder 13 and the front wall 14 are formed of synthetic resin. In the figure, reference numeral 17 denotes an intake valve and 18 denotes an expiration valve. The intake cylinder 13 is formed of a material such as synthetic resin and rubber which are hard or have a low resiliency, in case the mask body 12 is formed of a soft resilient material, but is formed of a material having a relatively high resiliency in case the mask body 12 is formed of a hard material such as light alloy. The front wall 14 is formed of a suitable material such as a rigid material, a flexible material and a soft resilient material. Depending on the properties of the filtration medium which forms the rear wall 15, the connecting pieces 16 can be totally omitted or in place of the connecting pieces 16, elongated support rods can be embedded into the filtration material constituting the rear wall 15 in radially mutually spaced relation from the intake cylinder 13 so that the connecting pieces 16 may be omitted. In use of the mask, the intake flows in a direction as indicated by the arrows in the figure and enters the intake chamber. The rear wall 15 composed of the filtration medium can avoid a damage resulting from the welding spatter by the presence of the front wall 14.

Figure 4:
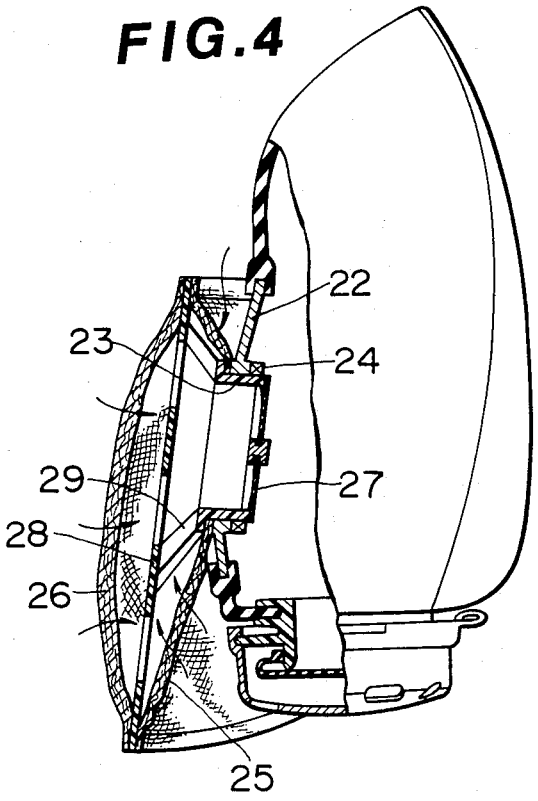
FIG. 4 is a cutaway side view of an essential portion of a further embodiment of the present invention.

FIG. 4 is a cutaway side view of an essential portion showing a further embodiment of the present invention. In this embodiment, a required hole is made in the front wall of the mask shown in FIG. 2, and the filtration medium is fastened airtight also to the outside of the front wall opposedly of the rear wall composed of the filtration medium by deposition, adhesion or the like. In the embodiment shown in FIG. 4, the intake cylinder 23 is mounted on the mask body 22 by tightening the nut 24 threadably engaged with an extreme end of the intake cylinder 23 extended into the mask body 22. The fitting lip portion fitted in the intake cylinder 23 of the rear wall 25 composed of the filtration medium is inserted between the flange of the intake cylinder 23 and the mask body 22 to serve as a packing which holds the mounting portion airtight. In FIG. 4, reference numeral 26 denotes a front wall composed of a filtration medium and 27 an intake valve.

In the embodiment of FIG. 4, since a greater part constituting the enclosure of the intake chamber comprises a filtration medium, an extremely large filtration area as compared with the size thereof can be obtained, and as a consequence, it is possible to obtain a mask which is small in size and low in intake resistance.

If the filtration is formed into a shape of an enclosure of the intake chamber and shape-retaining ribs are suitably embedded into said filtration medium (the ribs can be attached to the inner surface or outer surface of the filtration medium instead of being embedded), it is possible to form an arrangement which can dispense with a perforated plate 28 in the embodiment of FIG. 4 and connecting pieces 29 for supporting said perforated plate on the intake cylinder.

Alternatively, a layer of filtration medium may be formed by fastening the intake cylinder to the required portion of the group of ribs arranged in the shape of the enclosure of the intake chamber and thereafter adhering fibers or the like as a material of filtration medium to the group of ribs.

Figure 5:
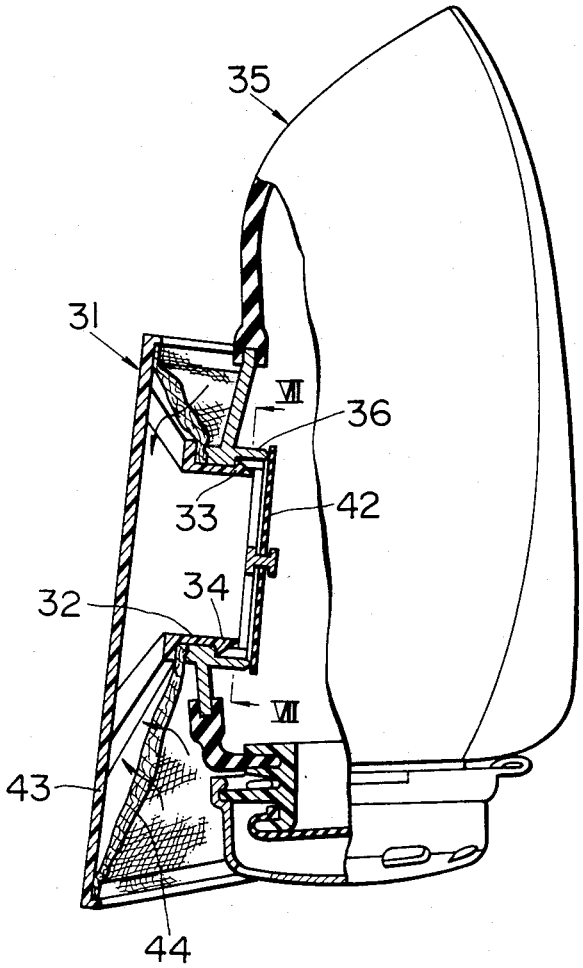
FIG. 5 is a cutaway side view in an enlarged scale of an essential portion showing a third embodiment of the present invention.
Figure 6:
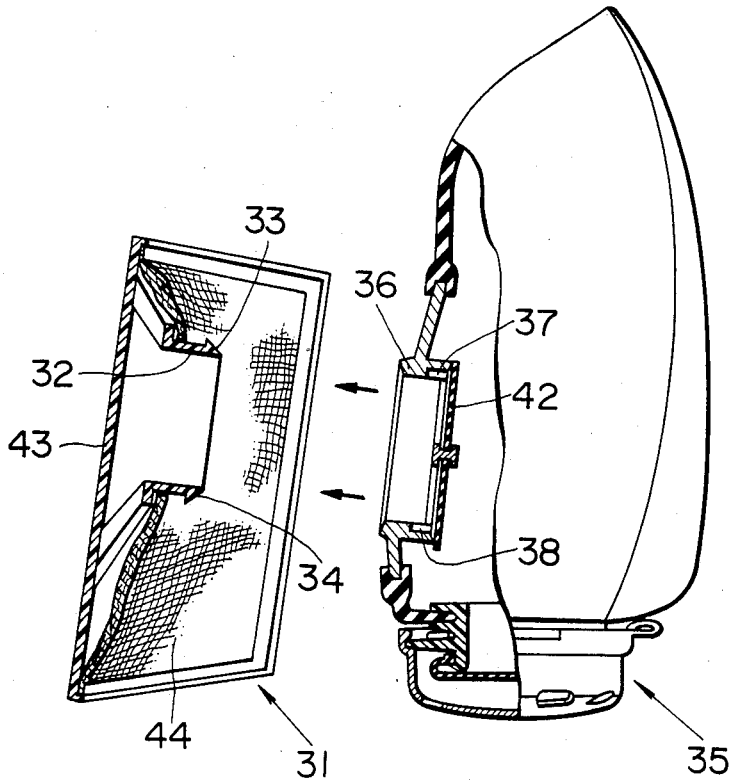
FIG. 6 shows a state where an intake chamber assembly of the embodiment shown in FIG. 5 is separated from a mask body.
Figure 7:
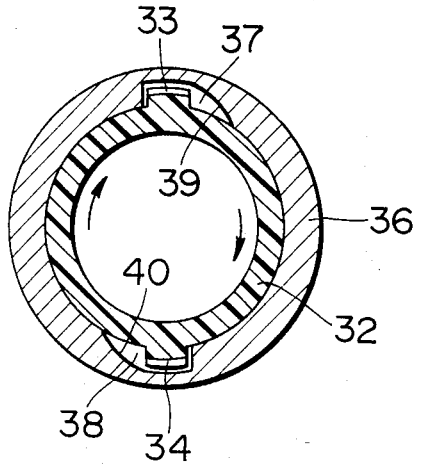
FIG. 7 is an enlarged sectional view taken along line VII—VII of FIG. 5.

FIGS. 5 to 7 show a third embodiment of the present invention.

In FIG. 5, a pair of engaging projections 33 and 34 opposedly projected on the peripheral surface of the outer end of the intake cylinder 32 are respectively engaged with a pair of engaging recesses 37 and 38 provided in the inner peripheral surface of a receiving cylinder 36 of the mask body 35 and thereby an intake chamber assembly 31 is mounted on the mask body 35. The engaging recesses 37 and 38 of the receiving cylinder 36 are respectively provided with engaging-releasing peripheral inclined surfaces 39 and 40 extending from the bottom thereof to the inner peripheral surface of the receiving cylinder 36 in the same peripheral direction. When the intake chamber of the intake chamber assembly 31 is held and the intake cylinder 32 is rotated by a predetermined angle in a direction as indicated by the arrow in FIG. 7 with respect to the receiving cylinder 36, and then the intake chamber assembly 31 is released from the mask body 35, then both are separated from each other as shown in FIG. 6. Upon rotation of the intake cylinder 32 in a direction as indicated by the arrows in FIG. 7, the engaging projections 33 and 34 of the intake cylinder 32 are respectively pressed by the peripheral inclined surfaces 39 and 40 and then resiliently withdrawn for disengagement from the engaging recesses 37 and 38, as a consequence of which the intake cylinder 34 can be removed for the receiving cylinder 16.

In mounting the intake chamber assembly 31 on the mask body 35, the engaging projections 33 and 34 of the intake cylinder 32 are respectively positioned opposedly of the engaging recesses 37 and 38 of the receiving cylinder 36 of the mask body to merely insert the intake cylinder 32 into the receiving cylinder 36, then the engaging projections 33 and 34 of the intake cylinder 32 are pressed towards the inner peripheral wall of the receiving cylinder 36 and resiliently withdrawn, under which condition the projections reach the engaging recesses 37 and 38, respectively, of the receiving cylinder 36, whereby they are brought into engagement with the engaging recesses 37 and 38 by the resilient stability thereof. In FIGS. 5 and 6, reference numeral 42 denotes an intake valve provided in an opening at the inner end of the receiving cylinder 36, 43 a front wall of the intake chamber formed of a synthetic resin plate, and 44 a rear wall of the intake chamber formed of a filtration medium. This third embodiment is characterized by the construction in which the intake chamber assembly 31 can be detachably mounted on the mask body 35.

Figure 8:
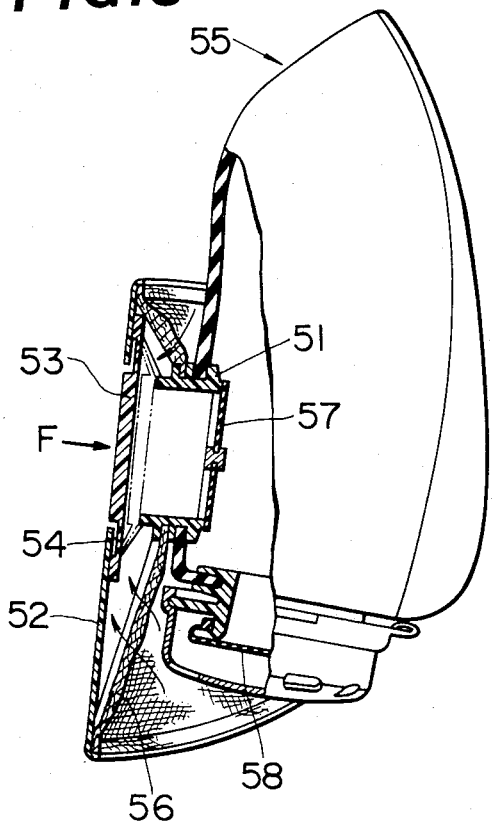
FIG. 8 is a cutaway side view of an essential portion showing a fourth embodiment of the present invention.
Figure 9:
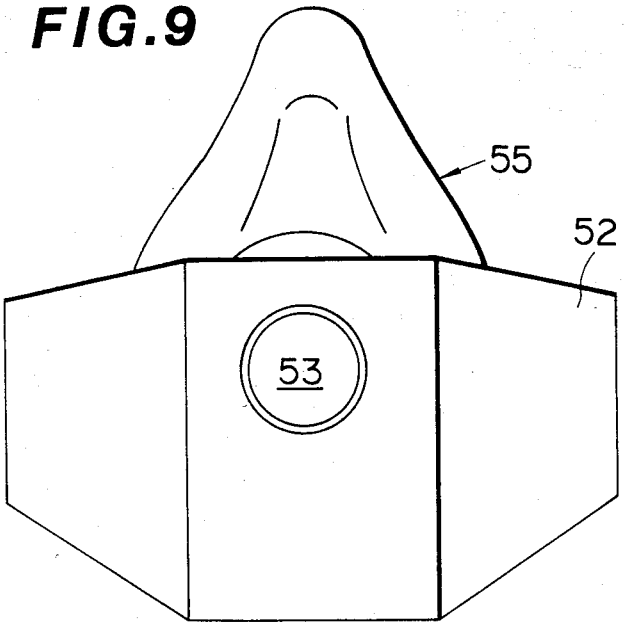
FIG. 9 is a reduced front view of the embodiment shown in FIG. 8.

FIG. 8 is a cutaway side view of an essential portion showing a fourth embodiment of the present invention. The characteristic of this embodiment resides in that an opening which is opposed to the opening at the inlet of intake of the intake cylinder 51 is provided in the front wall 52 of the intake chamber, and a plate-like closing body 53 is provided so as to close said opening. The closing body 53 has an airtight expansion film 54 associated with an outer peripheral edge thereof. An outer peripheral edge portion of the expansion film 54 is joined airtight to the back of the front wall 52. The closing body 53 is normally at a position shown in FIG. 8 but is moved upon depression by means of a finger or the like to a position indicated at dash-dotted contour lines at the intake flow-in opening of the intake cylinder 51. If the depression force F is released, the closing body 53 is returned to the position indicated at the solid line by the resilient returning force of the expansion film 54. Accordingly, the mask wearer, immediately after wearing the mask, depresses the closing body 53 by the finger to close the intake flow-in opening of the intake cylinder 51, whereby he can test the contact property between the mask body 55 and the face. In FIG. 8, 56 denotes a rear wall of the intake chamber formed of a filtration medium, 57 an intake valve, and 58 an expiration valve.

The closing body 53 may have a suitable shape suited to close the intake flow-in opening of the intake cylinder 51, for example, a frustoconical configuration.

While the closing body 53 and the expansion film 54 are normally formed of rubber, it is noted that they can be formed of other suitable material having required properties, for example, such as synthetic resin.

Figure 10:
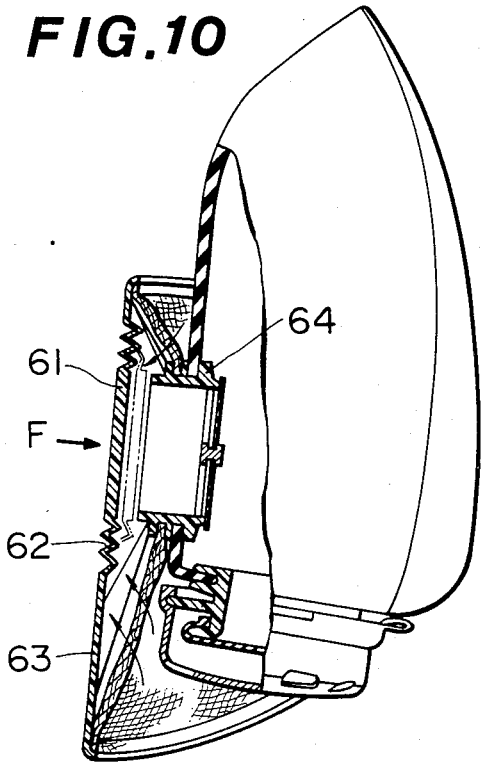
FIG. 10 is a cutaway side view of an essential portion showing a fifth embodiment in accordance with the present invention. In all these drawings, a string of the mask is omitted to be shown.

FIG. 10 shows an embodiment in which the closing body is formed integral with the front wall of the intake chamber. In this embodiment, the closing body 61 is connected to the front wall 63 of the intake chamber by means of the annular bellows portion 62 encircling the closing body 61 so that it may come into contact with and move away from the end edge of the intake flow-in opening of the intake cylinder 64 by the expansion and contraction of the annular bellows portion 62.

What is claimed is:

1. An intake chamber assembly for a mask comprising a front wall and a rear wall arranged to form an intake chamber therebetween, said front wall and rear wall each having a peripheral edge portion and said peripheral edge portions are hermetically joined together, said front wall is formed of a non-permeable plate-like material, said rear wall is formed of a filtration medium, said rear wall having a hole extending therethrough opening into said intake chamber, an intake cylinder fitted into the hole in said rear wall and hermetically connected to said rear wall, said intake cylinder forming an opening having one end communicating with said intake chamber and an opposite end adapted to be connected to said mask, said front wall disposed in spaced relation to the opening in said intake cylinder communicating with said intake chamber, connecting pieces extending between and connecting said front wall and said intake cylinder for maintaining the spaced relation between said front wall and said intake cylinder, a closing body located within said intake chamber opposite the opening in said intake cylinder communicating with said intake chamber, means for supporting body on said front wall within said intake chamber such that it has a first position spaced from the opening in said intake chamber and a second position where it closes the opening in said intake chamber and into which said second position it is displaceable from the first position by the depressing force of a finger so that when the depressing force is released said closing body returns automatically to the first position.

2. An intake chamber assembly as set forth in claim 1, wherein said front wall has a center portion and two side portions each located along one edge of said center portion, said center portion has a flat planar configuration and said side portions bent out of the plane of said center portion toward said rear wall.

3. A mask including a mask body having an intake opening and an intake chamber assembly including an intake chamber and an intake cylinder having an opening therethrough and communicating at one end with said intake chamber and at the other end thereof detachably mounted to and communicating with said mask body, said intake chamber assembly includes a front wall and a rear wall arranged to form an intake chamber, said front wall and rear wall each having a peripheral edge portion and said peripheral edge portions hermetically joined together, said front wall is formed of a non-permeable plate-like material, said rear wall is formed of a filtration medium, said rear wall having a hole extending therethrough and opening into said intake chamber, said intake cylinder fitted into the hole of said rear wall and hermetically connected to said rear wall, said front wall disposed in spaced relation to the opening in said intake cylinder communicating with said intake chamber, connecting pieces extending between and connecting said front wall and said intake cylinder for maintaining them in spaced relation, a closing body located within said intake chamber opposite the opening in said intake cylinder communicating with said intake chamber, means for supporting said closing body on said front wall within said intake chamber such that it has a first position spaced from the opening in said intake chamber and a second position closing the opening in said intake chamber and into which said second position it is displaceable by the depressing force of a finger so that when the depressing force is released said closing body returns automatically to the first position.

4. A mask, as set forth in claim 3, wherein said front wall has a center portion and two side portions each located along one edge of said center portion, said center portion has a flat planar configuration and said side portions bent out of the plane of said center position toward said rear wall.

5. A mask, as set forth in claim 3, wherein said intake cylinder extends in the axial direction between an inner end within said intake chamber and an outer end spaced outwardly from said intake chamber, a plurality of engaging projections extending laterally outwardly from the outer end of said intake cylinder, said mask body having engaging recesses therein for receiving said projections on said intake cylinder, and engagement-releasing inclined surfaces are formed in said engaging recesses in said mask body with said inclined surfaces extending from the bottom of said recesses inwardly toward said outer end of said intake cylinder for forming engagement-releasing surfaces.

* * * * *